US008224213B2

(12) United States Patent
Takemoto

(10) Patent No.: US 8,224,213 B2
(45) Date of Patent: Jul. 17, 2012

(54) TONER TRANSFERRING MECHANISM, DEVELOPING APPARATUS AND IMAGE FORMING APPARATUS THEREWITH

(75) Inventor: Mitsutoshi Takemoto, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 462 days.

(21) Appl. No.: 12/496,987

(22) Filed: Jul. 2, 2009

(65) Prior Publication Data

US 2010/0028051 A1 Feb. 4, 2010

(30) Foreign Application Priority Data

Jul. 30, 2008 (JP) ..... 2008-195596
Jul. 30, 2008 (JP) ..... 2008-195600

(51) Int. Cl.
*G03G 15/08* (2006.01)

(52) U.S. Cl. ..... 399/254; 399/256

(58) Field of Classification Search ..... 399/254
See application file for complete search history.

(56) References Cited

U.S. PATENT DOCUMENTS

2006/0222408 A1 10/2006 Suenami et al.
2007/0223969 A1 9/2007 Nishimura et al.

FOREIGN PATENT DOCUMENTS

| | | |
|---|---|---|
| JP | 7-49637 | 2/1995 |
| JP | 2006-301604 | 11/2006 |
| JP | 2007-264000 | 10/2007 |

*Primary Examiner* — David Gray
*Assistant Examiner* — Andrew Do
(74) *Attorney, Agent, or Firm* — Smith, Gambrell & Russell, LLP

(57) ABSTRACT

A toner transferring mechanism is provided with: an agitating and transferring member disposed in a housing accommodating toner, and having a blade portion thereof formed in a spiral shape on a circumferential portion of a rotatable shaft portion; and a plurality of scraping members making contact with the agitating and transferring member, and then scraping toner adhering to the agitating and transferring member, the scraping members being arranged in an axial direction of the agitating and transferring member, wherein the scraping members are arranged so that the scraping members adjacent to each other form an interval which is approximate to a spiral pitch of the blade portion of the agitating and transferring member.

10 Claims, 8 Drawing Sheets

TONER TRANSFERRING MECHANISM, DEVELOPING APPARATUS AND IMAGE FORMING APPARATUS THEREWITH

This application is based on Japanese Patent Application Nos. 2008-195596 and 2008-195600 filed on Jul. 30, 2008, and the contents of which are hereby incorporated by reference.

BACKGROUND OF THE INVENTION

1. Field of the Invention

The present invention relates to a toner transferring mechanism that transfers powdery toner using an agitating and transferring member having a blade portion formed in a spiral shape, the mechanism being adaptable for image forming apparatuses represented by copiers and printers. The present invention also relates to a developing apparatus and an image forming apparatus provided with such a toner transferring apparatus.

2. Description of Related Art

In electrophotographic image forming apparatuses such as copiers and printers, a photoconductive drum is widely used as an image carrying member. Generally, an image forming operation using a photoconductive drum is as follows: the surface of the photoconductive drum is uniformly charged at a predetermined potential by a charging apparatus, and that surface is then irradiated with light from an LED of an exposure apparatus, and the like whereby the potential is partially decreased owing to photo-induced discharge, and accordingly, an electrostatic latent image of an original document image is formed there. The electrostatic image thus formed is then developed by a developing apparatus so as to form a toner image. After the toner image is transferred to a sheet of paper, part of the toner left on the surface of the photoconductive drum is cleaned by a cleaning apparatus, and to prepare for the next image forming operation, the photoconductive drum is then irradiated with static-electricity eliminating light by a static-electricity eliminating apparatus, so that electrical charges carried by the photoconductive drum are removed therefrom.

Among other constituent components engaged in the above-described image forming operation, the developing apparatus is formed such that a housing thereof accommodates a predetermined amount of toner all the time. To achieve high-quality image forming, the toner so accommodated inside the housing needs to be evenly dispersed in a longitudinal direction of a developing roller inside the housing. Thus, in the developing apparatus, a toner transferring mechanism is widely employed that is provided with an agitating and transferring member having a blade portion thereof formed in a spiral shape on an outer circumferential portion of a rotatable shaft portion, and evenly dispersing the toner while transferring it in the longitudinal direction inside the housing with rotation of the member.

Moreover, in the cleaning apparatus, the toner removed from the photoconductive drum is temporarily accommodated, as waste toner, inside a housing of the cleaning apparatus. The waste toner, sequentially removed from the surface of the photoconductive drum and accommodated inside the housing of the cleaning apparatus during the image forming operation, needs to be discharged to outside, so that the housing is not filled with it. Thus, in the cleaning apparatus, as in the developing apparatus, a toner transferring mechanism is widely employed that is provided with an agitating and transferring member having a blade portion thereof formed in a spiral shape on an outer circumferential portion of a rotatable shaft portion, and transferring the toner to outside the housing with rotation of the member.

When the toner has been kept in the developing or cleaning apparatus for a long time, or when an ambient temperature of that apparatus rises, fluidity of the toner inside the housing decreases, possibly leading to that toner being stuck on the surface of the agitating and transferring member that agitates and simultaneously transfers the toner. When the toner is stuck on the agitating and transferring member and accumulated thereon, toner transfer performance is greatly degraded, possibly leading to a toner image, developed on the surface of the photoconductive drum, adversely affected thereby in the developing apparatus, and accordingly leading to a poor image formed on a sheet of paper. On the other hand, in the cleaning apparatus, such degraded performance possibly leads to waste toner overflowing and soiling the vicinity of the apparatus, or leads to waste toner adhering again to the surface of the photoconductive drum, causing degradation in cleaning performance. Moreover, the agitating and transferring member, as a result of being prevented from rotating smoothly by restriction imposed thereon, may be broken.

There have been some solutions proposed, with the aim of solving the above-described problems, for preventing toner from being stuck on a surface of an agitating and transferring member having a blade portion thereof formed in a spiral shape on an outer circumferential portion of a shaft portion; examples of such solutions can be seen in JP-A-H7-49637 and JP-A-2006-301604. Toner transferring mechanisms disclosed in these patent documents are each provided with a plurality of toner scraping members each making contact with a blade portion of an agitating and transferring member, the scraping members each swinging in accordance with rotation of the blade portion.

In the toner transferring mechanisms disclosed in the above-mentioned patent documents, the scraping members each formed with a sheet-like or wire-like member are made to rub a surface of the blade portion as the agitating and transferring member rotates; consequently, it is possible to prevent toner from being left on the blade portion and then stuck thereon, leading to improved toner transfer performance. In these toner transferring mechanisms, however, the plurality of scraping members are arranged at an interval which is equal to a spiral pitch of the blade portion of the agitating and transferring member; consequently, all the scraping members, when working together with the agitating and transferring member, form a same swinging pattern. That is, all the plurality of scraping members, as observed in a circumferential direction of the agitating and transferring member, make contact with the blade portion at same timing every time. Owing to this, the agitating and transferring member is more likely to receive a load, possibly leading to the agitating and transferring member interfered when rotating, or plastically deformed or bent to be broken.

Moreover, there is a concern that, in these toner transferring mechanisms disclosed in the above-mentioned patent documents, the scraping members are repeatedly deformed with rotation of the agitating and transferring member, and a load is intensively imposed on local part of the scraping members. As a result, there is a possibility that the scraping members are plastically deformed or bent to be broken at the part where the load has been intensively imposed. Moreover, there is a possibility that the scraping members thus broken interfere with the rotation of the agitating and transferring member, that the agitating and transferring member itself, an inner wall of a housing and other members inside the housing are broken, and that adherence of toner to the agitating and transferring member can no longer be prevented.

SUMMARY OF THE INVENTION

In view of the foregoing, the present invention is devised, and its object is to provide a toner transferring mechanism that can avoid interference with rotation of an agitating and transferring member, breakage of the agitating and transferring member and scraping members, and adherence of toner to the agitating and transferring member, and that can thus maintain satisfactory toner transfer performance. Moreover, another object of the present invention is to provide a highly-reliable developing apparatus and image forming apparatus provided with such a toner transferring mechanism.

To solve the above-described problems, a toner transferring mechanism is provided with: an agitating and transferring member disposed in a housing accommodating toner, and having a blade portion thereof formed in a spiral shape on a circumferential portion of a rotatable shaft portion; and a plurality of scraping members making contact with the agitating and transferring member, and then scraping toner adhering to the agitating and transferring member, the scraping members arranged in an axial direction of the agitating and transferring member, wherein the scraping members are arranged so that the scraping members adjacent to each other form an interval which is approximate to a spiral pitch of the blade portion of the agitating and transferring member.

With this construction, all the scraping members, as observed in a circumferential direction of the agitating and transferring member, come into contact with the blade portion at different timing. Moreover, those scraping members are arranged at the interval approximate to the spiral pitch of the blade portion; this prevents provision of an unnecessarily large number of the scraping members, leading to the scraping members less likely to abut each other. Thanks to these advantages, a load imposed on the agitating and transferring member and the scraping members is reduced, making it possible to avoid interference with rotation of the agitating and transferring member, and breakage, owing to plastic deformation or bending, of the agitating and transferring member and the scraping members. Thus, it is possible to provide a toner transferring mechanism that can prevent all the scraping members from swinging at same timing when swinging as the agitating and transferring member rotates, that can avoid adherence of toner to the agitating and transferring member, and that can maintain satisfactory toner transfer performance.

In the above-described toner transferring mechanism, the plurality of scraping members are arranged at a regular interval which is, smaller than the spiral pitch of the blade portion of the agitating and transferring member.

With this construction, as the agitating and transferring member rotates, the scraping members come into contact with the agitating and transferring member in order from a downstream side to an upstream side in a direction in which the agitating and transferring member transfers toner. Consequently, the scraping members are allowed, in order from the downstream side, to act to scrape toner adhering to the agitating and transferring member, and the toner so scraped is transferred onto the downstream side; this leads to increased ease of transferring the toner scraped on the upstream side to the downstream side. Thus, it is possible to provide a toner transferring mechanism that is more effective in maintaining its capability of avoiding adherence of toner to the agitating and transferring member, and of maintaining satisfactory transfer performance.

In the above-described toner transferring mechanism, the scraping members are each provided with a load absorbing portion located between a holding portion at which each of the scraping members is held in the housing and a contact portion making contact with the blade portion of the agitating and transferring member, the load absorbing portion allowed to be elastically deformed preceding any other portion.

With this construction, the scraping members are deformed at the load absorbing portions thereof as the agitating and transferring member rotates. Consequently, it is possible to absorb a repeated load imposed on the scraping members, and to avoid breakage, owing to plastic deformation or bending, of the scraping members. Thus, it is possible to provide a toner transferring mechanism that can avoid breakage of the scraping members even when repeatedly deformed with rotation of the agitating and transferring member, that can avoid adherence of toner to the agitating and transferring member, and that can thus maintain satisfactory toner transfer performance.

In the above-described toner transferring mechanism, the scraping members are each formed with a wire-like member, and the load absorbing portion is formed into a coil.

With this construction, it is possible to obtain a structure that can absorb a repeated load imposed on the scraping members, with a simple construction. Thus, it is possible to provide a toner transferring mechanism that can avoid breakage of the scraping members, and that can thus maintain satisfactory transfer performance, with ease.

In the above-described toner transferring mechanism, the scraping members are each formed with a sheet-like member, and are each provided with an opening serving as the load absorbing portion.

With this construction, it is possible to obtain a structure that can absorb a repeated load imposed on the scraping members, with a simpler construction. Thus, it is possible to provide a toner transferring mechanism that can avoid breakage of the scraping members, and that can thus maintain satisfactory toner transfer performance, with more ease.

According to another aspect of the present invention, a developing apparatus is provided with the toner transferring mechanism constructed as described above.

With this construction, it is possible to provide a highly-reliable developing apparatus that can avoid interference with rotation of the agitating and transferring member, breakage of the agitating and transferring member and the scraping members, and adherence of toner to the agitating and transferring member, and that can thus maintaining satisfactory toner transfer performance.

According to yet another aspect of the present invention, an image forming apparatus is provided with the toner transferring mechanism constructed as described above.

With this construction, it is possible to provide a highly-reliable image forming apparatus that can avoid interference with rotation of the agitating and transferring member, breakage of the agitating and transferring member and the scraping members, and adherence of toner to the agitating and transferring member, and that can thus maintain satisfactory toner transfer performance.

DETAILED DESCRIPTION OF PREFERRED EMBODIMENTS

Hereinafter, embodiments of the present invention will be described with reference to FIGS. 1 to 10.

Figure 1:
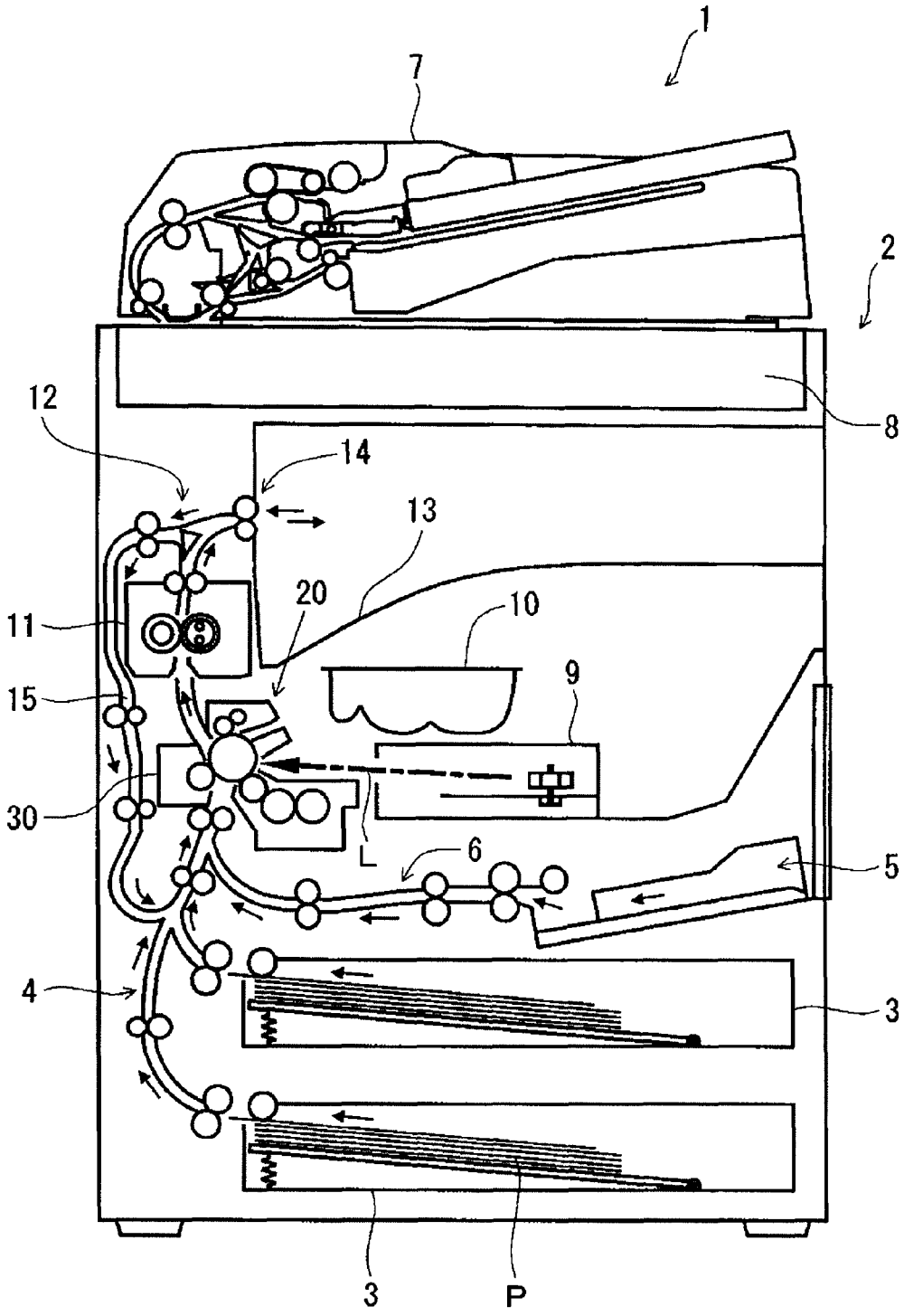
FIG. 1 is a vertical sectional view schematically showing an image forming apparatus provided with a toner transferring mechanism according to a first embodiment of the present invention.

First, in respect of an image forming apparatus provided with a toner transferring mechanism according to a first embodiment of the present invention, an outline of its construction will be described, with reference to FIG. 1, with the focus on an image outputting operation. FIG. 1 is a vertical sectional front view schematically showing an image forming apparatus. In FIG. 1, arrowed solid lines represent sheet conveyance passages and directions, and an arrowed dash-dot line represents a laser beam L.

As shown in FIG. 1, sheet feeding cassettes 3 serving as sheet feeding sections are disposed at the bottom inside a main body 2 of an image forming apparatus 1. The sheet feeding cassettes 3 each accommodate sheets of paper P, such as unprinted cut sheets of paper, in the form of a stack. The sheets of paper P are separated and fed, one after another, in a left-upward direction of the sheet feeding cassettes 3 in FIG. 1. The sheet feeding cassettes 3 can be horizontally pulled out from the front side of the main body 2.

Inside the main body 2, a first sheet conveying section 4 is disposed on a left side of the sheet feeding cassettes 3. The first sheet conveying section 4 is formed substantially vertically along a left-side surface of the main body 2. The first sheet conveying section 4 receives sheets of paper P fed out of the sheet feeding cassettes 3, and conveys them vertically upward along the left-side surface of the main body 2 up to a transferring section 30.

Above the sheet feeding cassettes 3, a manual sheet feeding section 5 is disposed in a right-side surface of the main body 2, which is a surface on a side opposite to the left side of the main body 2, where the first sheet conveying section 4 is formed. On the manual sheet feeding section 5, whatever desirably fed one by one, such as sheets of paper P with a size other than those handled by the sheet feeding cassettes 3, thick paper and OHP sheets, are loaded.

On a left side of the manual sheet feeding section 5, a second sheet conveying section 6 is disposed. The second sheet conveying section 6, located right above the sheet feeding cassettes 3, extends substantially horizontally starting from the manual sheet feeding section 5 to the first sheet conveying section 4, and joins the first sheet conveying section 4. The second sheet conveying section 6 receives sheets of paper P fed out of the manual sheet feeding section 5, and conveys them substantially horizontally to the first sheet conveying section 4.

On the other hand, an original document conveying apparatus 7 is disposed above an upper surface of the main body 2 of the image forming apparatus 1, and an image reading apparatus 8 is disposed below the original document conveying apparatus 7. To copy an original document, a user places, on the original document conveying apparatus 7 in the form of a stack, sheets of an original document having images such as letters, figures, patterns or the like written thereon. The original document conveying apparatus 7 separates and conveys one sheet after another from the stack, and then the image reading apparatus 8 reads image data of that sheet.

Starting of reading of an original document, namely printing is performed by using an operational panel (not shown) disposed at the top of the main body 2, at the front surface side of the image reading apparatus 8. Through this panel, a user can enter and set printing conditions, etc., such as the size of a sheet to be used, selection of enlargement or reduction, and selection of double-side printing.

Information of the image data of the original document is sent to an exposure apparatus 9 disposed above the second sheet conveying section 6 in the middle portion of the main body 2. The exposure apparatus 9 shines the laser beam L, which is controlled based on the image data, toward an image forming section 20.

Above the first sheet conveying section 4 and to the left of the exposure apparatus 9, an image forming section 20 and a transferring section 30 are disposed. In the image forming section 20, an electrostatic latent image of the original document is formed with the laser beam L shone by the exposure apparatus 9, and from this electrostatic latent image, a toner image is then developed. Toner is supplied from a toner container 10 disposed above the exposure apparatus 9 to the image forming section 20. The toner image thus formed by the image forming section 20 is transferred, by the transferring section 30, onto an unprinted sheet of paper P that has been synchronously conveyed there by the first sheet conveying section 4.

A fixing section 11 is disposed above the transferring section 30. The sheet of paper P that is made to carry an unfixed toner image by the transferring section 30 is then conveyed to the fixing section 11, and there that toner image is heated and pressed on the sheet by heating and pressing rollers, so that the image is fixed thereon.

Above the fixing apparatus 11, a branching section 12 is disposed. When no double-side printing is performed, a sheet of paper P ejected from the fixing apparatus 11 is then ejected, through the branching section 12, into an internal ejected sheet section 13 disposed inside the body frame of the image forming apparatus 1.

An exit through which a sheet of paper P is ejected from the branching section 12 to the internal ejected sheet section 13 functions as a switchback section 14. When double-side printing is performed, the switchback section 14 changes the conveyance direction of a sheet of paper P ejected from the fixing apparatus 11. Then, the sheet of paper P, passing through the branching section 12, is conveyed downward through the double-side printing sheet conveyance passage 15 disposed on a left side of the fixing and transferring sections 11 and 30, and is then conveyed to the transferring section 30 through the first sheet conveying section 4 again.

Figure 2:
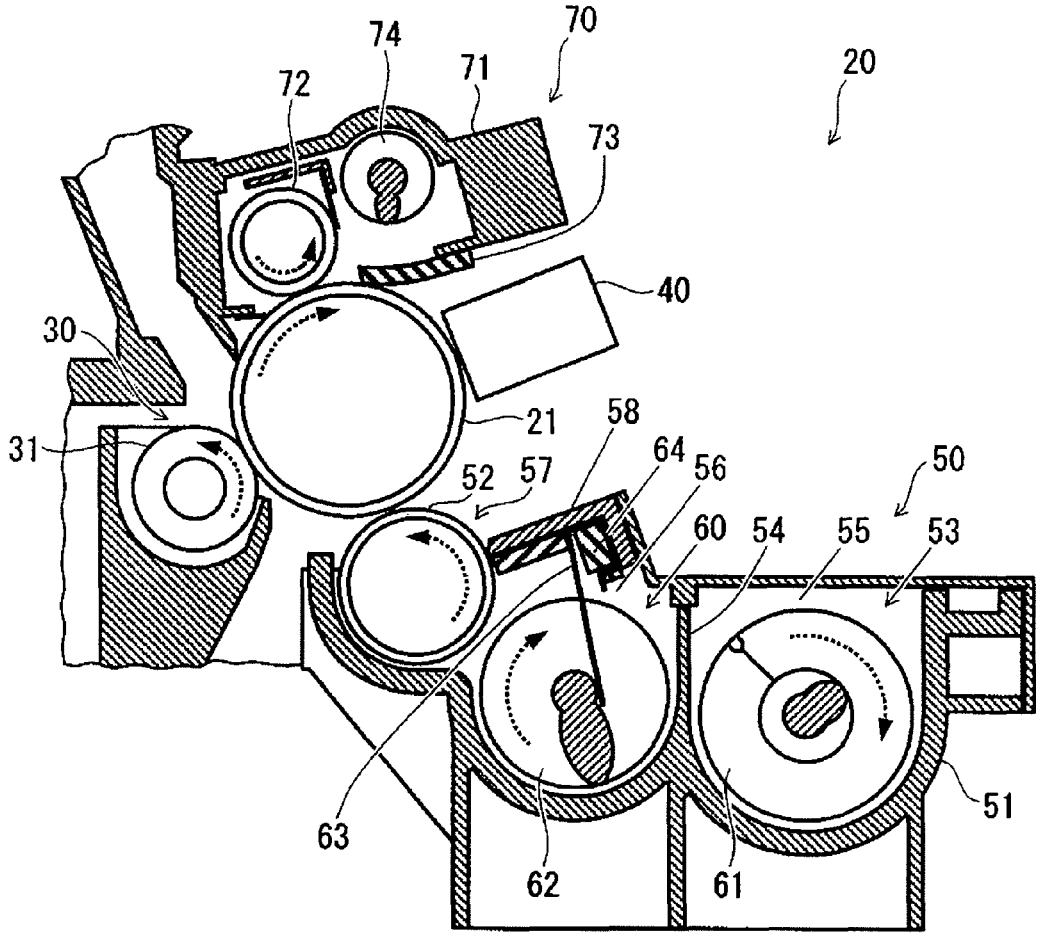
FIG. 2 is a partially enlarged vertical sectional front view of an image forming section in FIG. 1.

Next, a construction of an image forming section 20 of the image forming apparatus 1 and the vicinity thereof will be described in detail with reference to FIG. 2 in addition to FIG. 1. FIG. 2 is a partially enlarged vertical sectional front view of an image forming section.

As shown in FIG. 2, the image forming section 20 is provided, in its center, with a photoconductive drum 21 serving as a image carrying member. In the vicinity of the photoconductive drum 21, a charging apparatus 40, a developing apparatus 50, and a cleaning apparatus 70 are arranged in this order in a rotation direction of the photoconductive drum 21. The transferring section 30 is disposed between the developing apparatus 50 and the cleaning apparatus 70 in the rotation direction of the photoconductive drum 21.

The photoconductive drum 21 extends in a sheet width direction perpendicular to a sheet conveyance direction within the image forming apparatus 1, namely in a sheet-plane transverse direction, and is disposed with its axial direction positioned horizontally. The photoconductive drum 21 is an inorganic photoconductive drum provided with a photoconductive layer made of amorphous silicon, which is an inorganic light-conductive material, by vacuum-deposition and the like, and has a diameter of 30 mm. The photoconductive drum 21 is made to rotate with its circumferential speed substantially same as the sheet conveyance speed (e.g., 125 mm/s).

The charging apparatus 40 is a scorotron charging apparatus using a corona-discharge charger. Apart from that, a corotron charging apparatus similarly using a corona discharge charger, or a contact-type charger using a roller, brush and the like may be employed. This charging apparatus 40 uniformly charges a surface of the photoconductive drum 21 at a predetermined polarity and potential. Typically, a charging potential for this is +350 V.

The developing apparatus 50 is provided, in its housing 51, with a developing roller 52. The developing roller 52 employs a magnetic toner projection developing process, and is disposed in the vicinity of the photoconductive drum 21. A bias with a polarity same as that of the charging polarity of the photoconductive drum 21 is applied to the developing roller 52. By this developing roller 52, toner serving as a developer is electrically charged and transferred to an electrostatic latent image on the surface of the photoconductive drum 21, and thereby the electrostatic latent image is developed.

The toner is styrene-acrylate-based magnetic single-component toner accommodated in the toner container 10 shown in FIG. 1. The toner container 10 can be joined together with the housing 51 of the developing apparatus 50, and the toner is supplied from the toner container 10 into the housing 51. The type of developing process employed by the developing apparatus and the kind of toner to be used are not limit to those mentioned above; for example, a two-component developer may also be used. A construction of the developing apparatus 50 will be described in detail later.

The transferring section 30 is provided with a transferring roller 31 that is a transferring member. The transferring roller makes press-contact with the photoconductive drum 21 from the left in FIG. 2, and forms a transferring nip portion through which a sheet of paper P is passed. Having no driving apparatus, the transferring roller 31 comes into contact with the photoconductive drum 21, and is rotated with the rotation of the photoconductive drum 21. Moreover, a transferring bias of −500 to −1000 V, of which a polarity is opposite to that of the electric charges given to the photoconductive drum 21 and the toner, is applied to the transferring roller 31.

The cleaning apparatus 70 is disposed, as shown in FIG. 2, above the photoconductive drum 21 on a downstream side of the transferring section 30 in the rotation direction of the photoconductive drum 21. The cleaning apparatus 70 is provided, in its housing 71, with a cleaning roller 72, cleaning blade 73, and toner discharging screw 74.

The cleaning roller 72 and cleaning blade 73 are urged by an elastic member such as an unillustrated spring and the like, and is pressed against the photoconductive drum 21. The cleaning roller 72 and cleaning blade 73 extend in an axial direction of the photoconductive drum 21, and have a length in the axial direction substantially equal to that of the photoconductive drum 21.

To achieve efficient cleaning of the surface of the photoconductive drum 21, a surface of the cleaning roller 72 that makes contact with the photoconductive drum 21 is made to rotate, by an unillustrated driving apparatus, in a same direction as the surface of the photoconductive drum 21 rotates, so that a circumferential speed of the cleaning roller 72 is faster than that of the photoconductive drum 21 by approximately 15 to 20%. The cleaning roller 72 serves to remove adhering substances such as residual toner from the surface of the photoconductive drum 21, and simultaneously to polish the surface of the photoconductive drum 21 with toner adhering to the surface of the cleaning roller 72 and containing abrasives so as to clean the surface of the photoconductive drum 21. Moreover, the cleaning blade 73 serves to scrape adhering substances such as residual toner left on the surface of the photoconductive drum 21 so as to clean it.

The toner discharging screw 74 is a rotating member rotating around an axis thereof substantially parallel to an axis of the cleaning roller 72, and extends from inside the housing 71 to a waste toner collecting container (not shown) disposed outside the image forming section 20. The toner discharging screw 74 serves to discharge waste toner removed from the surface of the photoconductive drum 21 and used for a cleaning purpose from inside the housing 71 to outside, namely to the waste toner collecting container.

Figure 3:
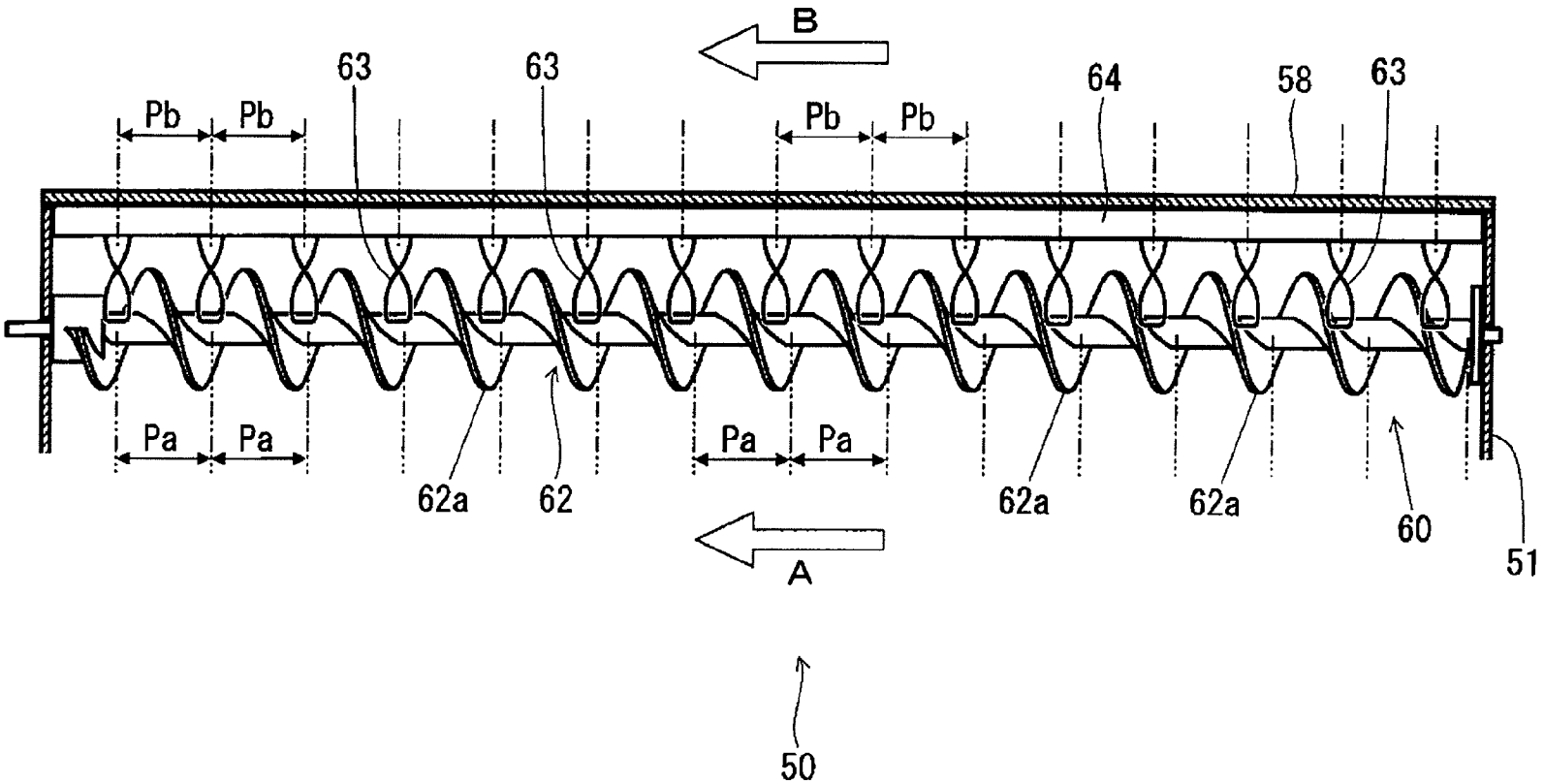
FIG. 3 is a sectional view of a second agitating and transferring member inside a developing apparatus shown in FIG. 2 as seen from a side of a first agitating and transferring member.
Figure 4:
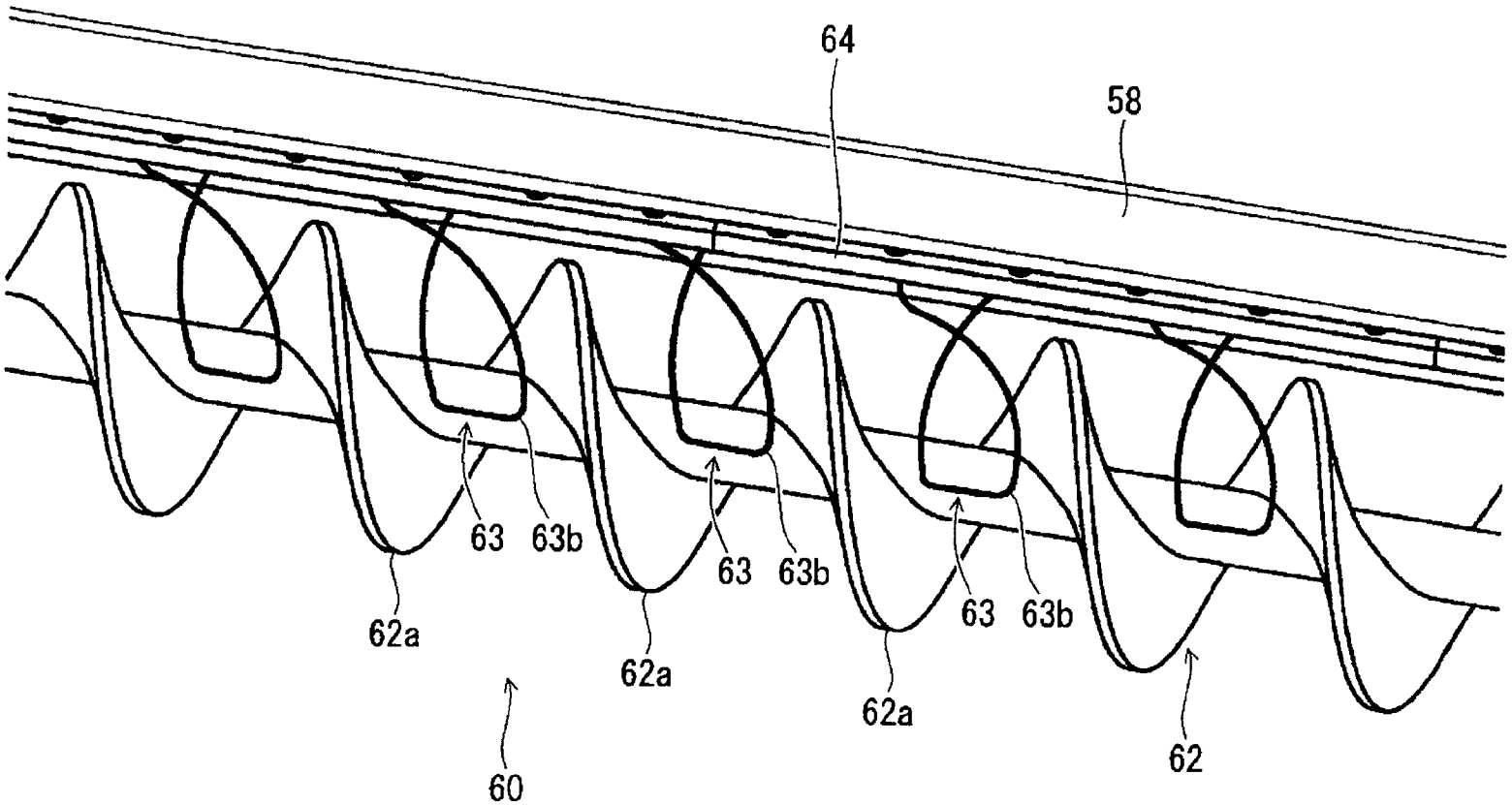
FIG. 4 is a perspective view of part of the second agitating and transferring member inside the developing apparatus shown in FIG. 2.
Figure 5:
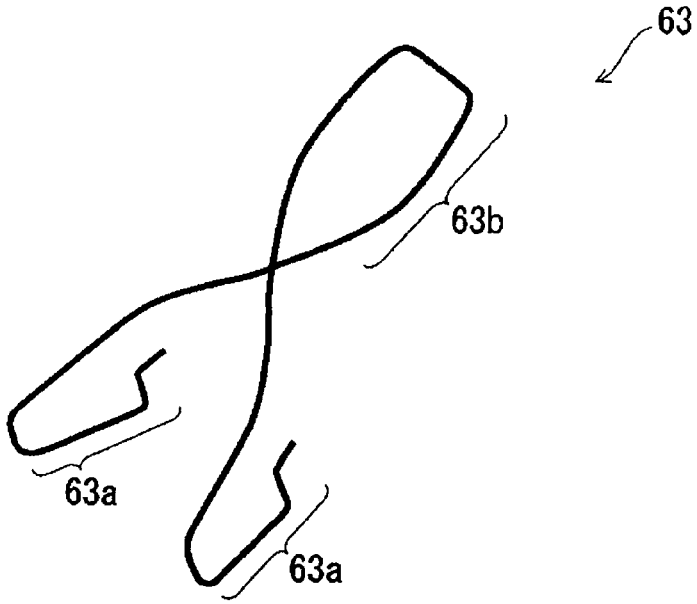
FIG. 5 is a perspective view of a scraping member shown in FIGS. 3 and 4.

Next, a construction of the developing apparatus 50 will be described in detail with reference to FIGS. 3 to 5 in addition to FIG. 2. FIG. 3 is a sectional view of a second agitating and transferring member inside the developing apparatus as seen from a side of the first agitating and transferring member, similarly FIG. 4 is a perspective view of part of the second agitating and transferring member, and FIG. 5 is a perspective view of a scraping member shown in FIGS. 3 and 4.

As shown in FIG. 2, the developing apparatus 50 is provided with a housing 51. The housing 51 accommodates, as a developer, magnetic single-component toner. The housing 51 is formed in an oblong shape in the axial direction of the photoconductive drum 21, and is disposed with its longitudinal direction positioned horizontally. As a main component inside the housing 51, an agitating chamber 53 agitating and simultaneously transferring toner is provided. An interior of the agitating chamber 53 is partitioned into two sections, namely left and right sections in FIG. 2 by a partition wall 54 extending in a longitudinal direction of the housing 51. The right section is a first chamber 55, and the left section is a second chamber 56.

The second chamber 56 is provided with an opening portion 57 at a location adjacent to the photoconductive drum 21. In the opening portion 57, the developing roller 52 serving as a developer carrying member is disposed. The developing roller 52, with its circumferential surface, at one side thereof, located inside the second chamber 56 and, at the other side thereof, exposed to outside the second chamber 56, faces the photoconductive drum 21 serving as an image carrying member. The developing roller 52 is rotated counterclockwise in FIG. 2 by an unillustrated driving unit.

A restricting plate 58 is provided starting from inside the second chamber 56 of the developing roller 52 to a downstream side of the developing roller 52, namely to an upper right side of the developing roller 52 in FIG. 2. The restricting plate 58 is so arranged as to form a gap having a predetermined width between a lower end of the restricting plate 58 and a surface of the developing roller 52.

Inside the agitating chamber 53, the partition wall 54 is not entirely provided between opposite ends thereof in the longitudinal direction, but it is formed such that the first and second chambers 55 and 56 communicate with each other via spaces provided at opposite end portions of the partition wall 54. In the first and second chambers 55 and 56, a toner transferring mechanism 60 is disposed. The toner transferring mechanism 60 is provided with: a first agitating and transferring member 61; a second agitating and transferring member 62; a plurality of scraping members 63; and a holding member 64.

The first and second agitating and transferring members 61 and 62 are provided, for agitating and transferring toner, inside the first and second chambers 55 and 56, respectively, with each axis arranged horizontally. These agitating and transferring members each have a blade portion thereof formed in a spiral shape on a circumferential portion of a rotatable shaft portion. The first agitating and transferring member 61 transfers toner to the far side of FIG. 2, and the second agitating and transferring member 62 transfers toner to the near side of FIG. 2. Thus, toner is circulated being agitated and simultaneously transferred between the first and second chambers 55 and 56.

The second agitating and transferring member 62 is provided with the scraping members 63 as shown in FIGS. 2 to 4. The scraping members 63 are arranged at a regular interval in an axial direction of the second agitating and transferring member 62. The scraping members 63 adjacent to each other form an interval Pb which is approximate to a spiral pitch Pa of a blade portion 62*a* of the second agitating and transferring member 62, and which is smaller than the spiral pitch Pa as shown in FIG. 3.

As shown in FIG. 2, the scraping members 63 are held in the housing 51 with the holding member 64 disposed on the back side of the restricting plate 58 of the housing 51, and is so formed as to extend downward toward the second agitating and transferring member 62. The scraping members 63 are so arranged as to make contact with the second agitating and transferring member 62, the scraping members 63 each having a tip end portion thereof located on a side of the first chamber 55 with respect to the shaft portion of the second agitating and transferring member 62.

Moreover, the scraping members 63 are each composed of a wire-like member as shown in FIG. 5. The scraping members 63 are each provided with a plurality of holding portions 63*a* and a contact portion 63*b* making contact with the blade portion 62*a* of the second agitating and transferring member 62.

As the second agitating and transferring member 62 rotates, the blade portion 62*a* rotates so as to transfer toner, as described earlier, to the near side of FIG. 2, namely in a direction indicated by arrow A in FIG. 3. Meanwhile, since the scraping members 63 are disposed at the interval Pb which is different from and smaller than the spiral pitch Pa of the blade portion 62*a*, they come into contact with the blade portion 62*a* in order from a downstream side to an upstream side in a direction in which they transfer toner, namely in a direction indicated by arrow B in FIG. 3, as the second agitating and transferring member 62 rotates. In each of the scraping members 63, the contact portion 63*b*, which is a tip end portion shown in FIG. 4, comes into contact with the blade portion 62*a*, and repeatedly deforms and swings so as to rub a surface of the blade portion 62*a*, thereby to scrape the toner on that surface.

As described above, the scraping members 63 are arranged at a regular interval, and the scraping members 63 adjacent to each other form the interval Pb which is approximate to the spiral pitch Pa of the blade portion 62*a*; this permits the plurality of the scraping members 63, as observed in a circumferential direction of the agitating and transferring member 62, to come into contact with the blade portion 62*a* at different timing. Moreover, the interval Pb between the scraping members 63 is approximate to the spiral pitch Pa of the blade portion 62*a*; this prevents provision of an unnecessarily large number of the scraping members 63, leading to the scraping members 63 less likely to abut each other. This helps reduce a load imposed on the second agitating and transferring member 62 and the scraping members 63, making it possible to avoid interference with rotation of the second agitating and transferring member 62, and breakage, owing to plastic deformation or bending, of the second agitating and transferring member 62 and the scraping members 63. Thus, it is possible to provide the toner transferring mechanism 60 that can prevent all the scraping members 63 from swinging at same timing when swinging as the second agitating and transferring member 62 rotates, that can avoid adherence of toner to the second agitating and transferring member 62, and that can thus maintain satisfactory toner transfer performance.

Moreover, the plurality of scraping members 63 are arranged at a regular interval, namely at the interval Pb smaller than the spiral pitch Pa of the blade portion 62*a* of the second agitating and transferring member 62; thus, as the second agitating and transferring member 62 rotates, the scraping members 63 come into contact with the second agitating and transferring member 62 in order from the downstream side to the upstream side in the direction in which the second agitating and transferring member 62 transfers toner. Consequently, the scraping members 63 are allowed, in order from the downstream side, to act to scrape toner adhering to the second agitating and transferring member 62, and the toner so scraped is transferred onto the downstream side; this leads to increased ease of transferring the toner scraped on the upstream side to the downstream side. Thus, it is possible to provide the toner transferring mechanism 60 that is more effective in maintaining its capability of avoiding adherence of toner to the second agitating and transferring member 62, and of maintaining satisfactory toner transfer performance.

Figure 6:
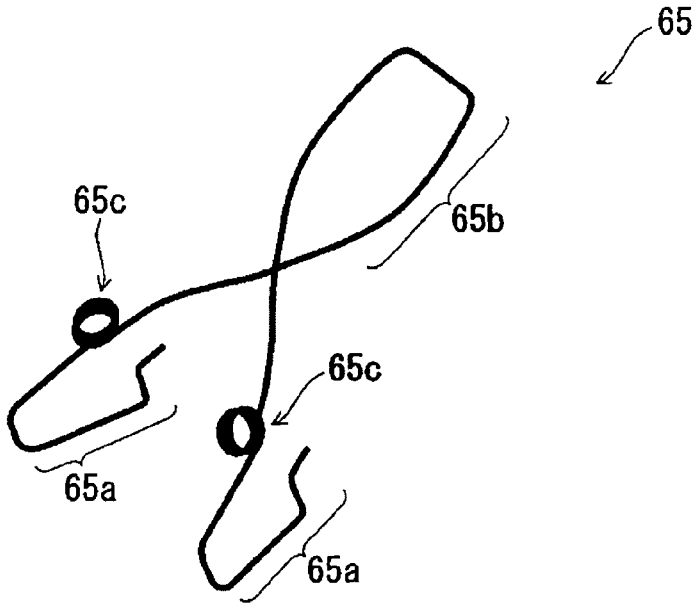
FIG. 6 is a perspective view of a scraping member of a toner transferring mechanism according to a second embodiment of the present invention.

Next, a toner transferring mechanism according to a second embodiment of the present invention will be described in detail with reference to FIG. 6. FIG. 6 is a perspective view of a scraping member of the toner transferring mechanism. Since a construction of this embodiment is basically the same as that of the first embodiment described above with reference to FIGS. 1 to 5, neither illustration nor description of the same components as those found in the first embodiment will be given.

A toner transferring mechanism according to the second embodiment is provided with a plurality of scraping members 65 as shown in FIG. 6. The scraping member 65 is provided with a plurality of holding portions 65*a* being held in the housing 51 with the holding member 64 and a contact portion 65*b* making contact with the blade portion 62*a* of the second agitating and transferring member 62, and in addition, the scraping member 65 is provided with a load absorbing portion 65*c* between these portions 65*a* and 65*b*. The load absorbing portion 65*c* is formed into a coil, and can be elastically deformed preceding the other portions such as the holding portions 65*a* and the contact portion 65*b*.

As the second agitating and transferring member 62 rotates, the blade portion 62*a* rotates so as to transfer toner, as described earlier, to the near side of FIG. 2, namely in the direction indicated by arrow A in FIG. 3. Meanwhile, since the scraping members 65 are disposed at the interval Pb which is different from and smaller than the spiral pitch Pa of the blade portion 62*a*, they come into contact with the blade portion 62*a* in order from the downstream side to the upstream side in the direction in which they transfer toner, namely in the direction indicated by arrow B in FIG. 3, as the second agitating and transferring member 62 rotates. In each of the scraping member 65, the contact portion 65*b*, which is a tip end portion shown in FIG. 4, comes into contact with the blade portion 62*a*, and repeatedly deforms and swings so as to rub a surface of the blade portion 62*a*, thereby to scrape the toner on that surface. Meanwhile, in the scraping member 65, mainly the load absorbing portion 65*c* is elastically deformed.

As described above, the scraping member 65 is provided with the load absorbing portion 65*c* that can be elastically deformed preceding the other portions; thus, the scraping members 65 are deformed at the load absorbing portion 65*c* as the second agitating and transferring member 62 rotates. Accordingly, it is possible to absorb repeated load imposed on the scraping members 65, and to avoid breakage, owing to plastic deformation or bending, thereof. Thus, it is possible to provide the toner transferring mechanism 60 that can avoid, despite the scraping members 65 being repeatedly deformed as the second agitating and transferring member 62 rotates, breakage of the scraping member 65 and adherence of toner to the second agitating and transferring member 62, and that can thus maintain satisfactory toner transferring performance.

Moreover, the load absorbing portion 65*c* is formed into a coil; thus, it is possible to obtain a structure that can absorb a repeated load imposed on the scraping members 65, with a simple construction. Thus, it is possible to provide a toner transferring mechanism 60 that can avoid breakage of the scraping members 65, and that thus maintain satisfactory toner transferring performance, with ease.

Figure 7:
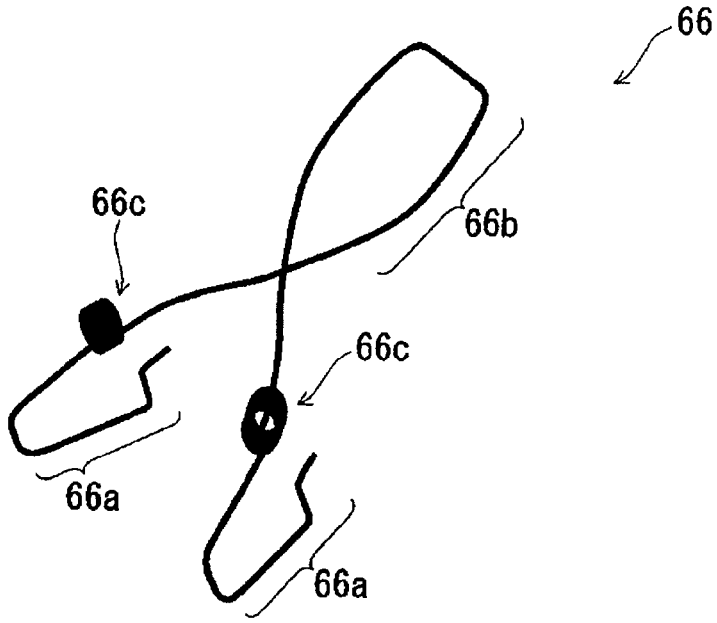
FIG. 7 is a perspective view of a scraping member of a toner transferring mechanism according to a third embodiment of the present invention.

Next, a construction of a toner transferring mechanism according to a third embodiment of the present invention will be described with reference to FIG. 7. FIG. 7 is a perspective view of a scraping member of the toner transferring mechanism. Since a construction of this embodiment is basically the same as those of the first and second embodiments described above with reference to FIGS. 1 to 6, neither illustration nor description of the same components as those found in the first and second embodiments will be given.

A toner transferring mechanism according to the third embodiment is provided with a plurality of scraping members 66 as shown in FIG. 7. Like the scraping members 65 of the second embodiment, the scraping members 66 are each provided with a plurality of holding portions 66*a* being held in the housing 51 with the holding member 64, a contact portion 66*b* making contact with the blade portion 62*a* of the second agitating and transferring member 62, and a load absorbing portion 66*c* that can be elastically deformed preceding the other portions. The load absorbing portion 66*c* is formed into a tension coil.

With this construction, as in the second embodiment, it is possible to obtain a structure that can absorb a repeated load imposed on the scraping members 66, with a simple construction. Thus, it is possible to provide the toner transferring mechanism that can avoid breakage of the scraping members 66, and that can thus maintain satisfactory toner transferring performance, with ease.

Figure 8:
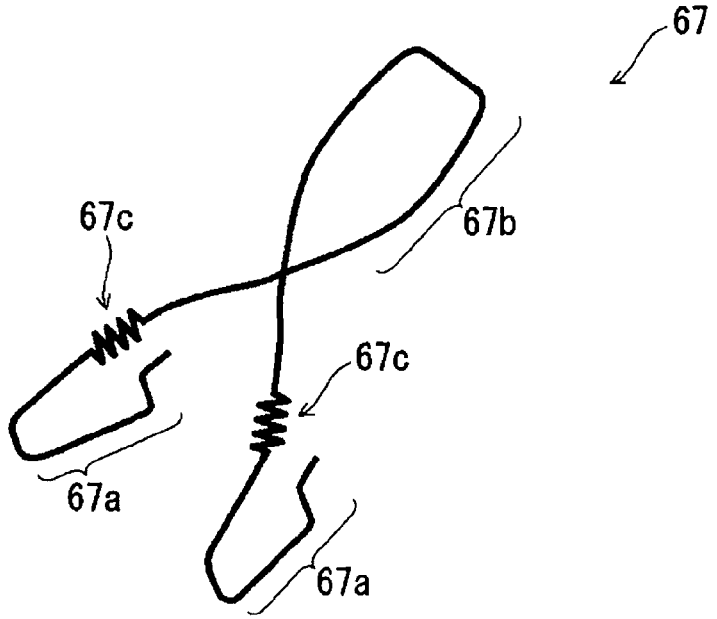
FIG. 8 is a perspective view of a scraping member of a toner transferring mechanism according to a fourth embodiment of the present invention.

Next, a construction of a toner transferring mechanism according to a fourth embodiment of the present invention will be described in detail with reference to FIG. 8. FIG. 8 is a perspective view of a scraping member of the toner transferring mechanism. Since a construction of this embodiment is basically the same as those of the first and second embodiments described with reference to FIGS. 1 to 6, neither illustration nor description of the same components as those found in the first and second embodiments will be given.

A toner transferring mechanism of the fourth embodiment is provided with a plurality of scraping members 67 as shown in FIG. 8. Like the scraping members 65 of the second embodiment, the scraping members 67 are each provided with a plurality of holding portions 67*a* being held in the housing 51 with the holding member 64, a contact portion 67*b* making contact with the blade portion 62*a* of the second agitating and transferring member 62, and a load absorbing portion 67*c* that can be elastically deformed preceding the other portions. The load absorbing portion 67*c* is formed by bending a wire-like member into a folding line or an accordion shape.

Despite that the load absorbing portions 67*c* are formed as described above, as in the second embodiment, it is possible to obtain a structure that can absorb a repeated load imposed on the scraping members 67, with a simple construction. Thus, it is possible to provide the toner transferring mechanism that can avoid breakage of the scraping members 67, and that can thus maintain satisfactory toner transferring performance, with ease.

Figure 9:
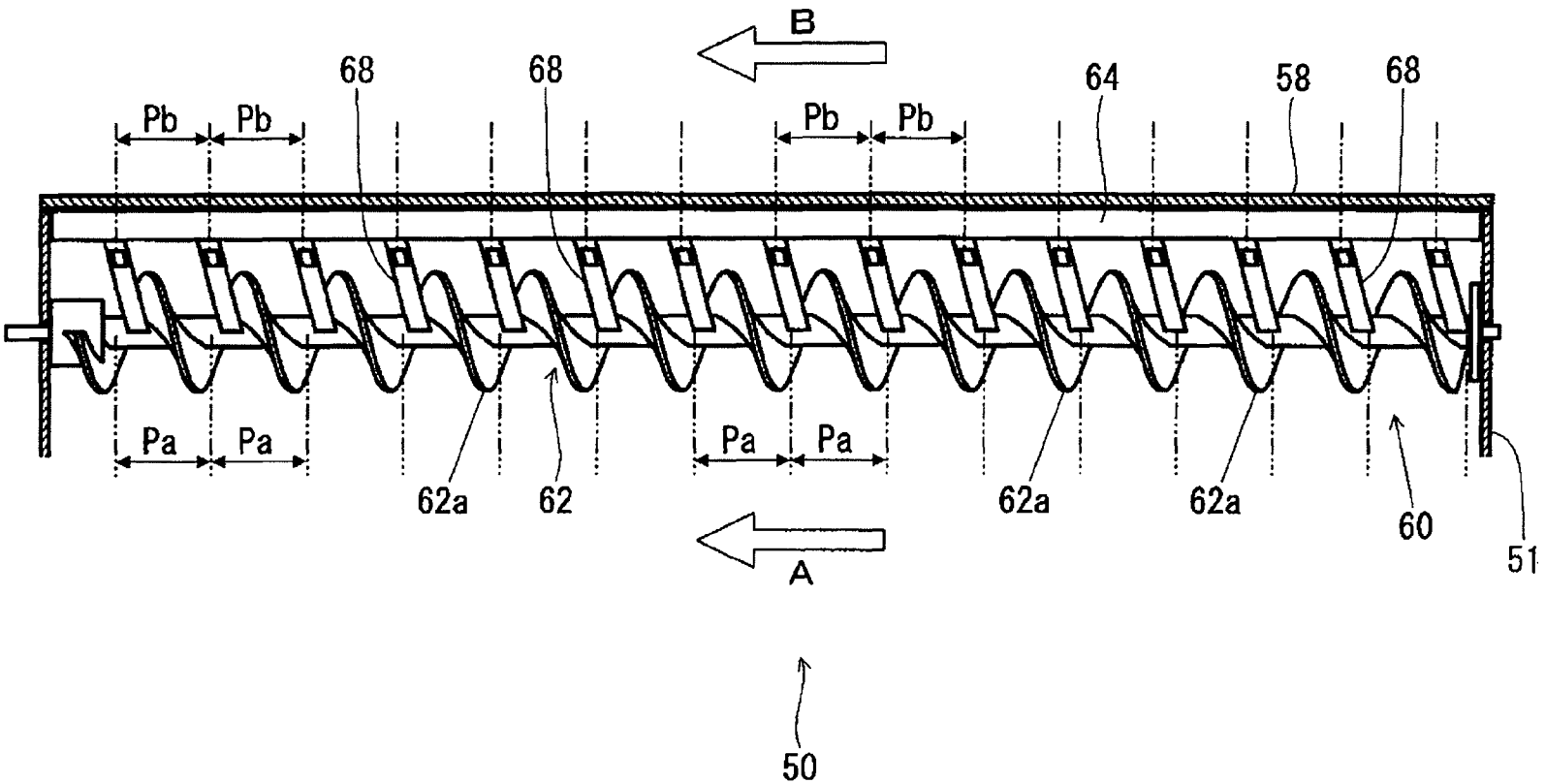
FIG. 9 is a sectional view, as seen from a side of a first agitating and transferring member, of a second agitating and transferring member inside a developing apparatus provided with a toner transferring mechanism according to a fifth embodiment of the present invention.
Figure 10:
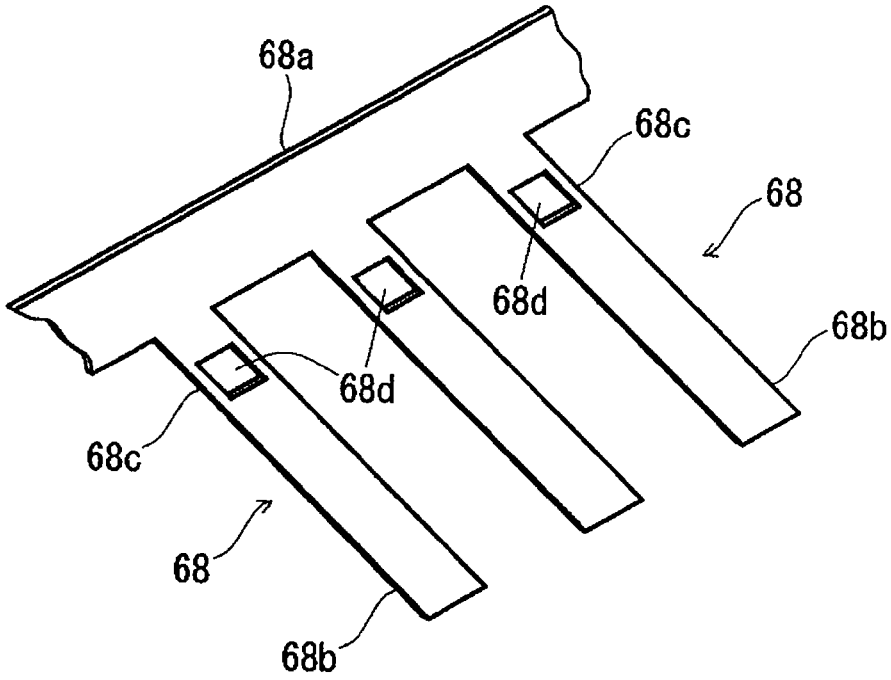
FIG. 10 is a perspective view of a scraping member shown in FIG. 9.

Next, a construction of a toner transferring mechanism according to a fifth embodiment of the present invention will be described in detail with reference to FIGS. 9 and 10. FIG. 9 is a sectional view of a second agitating and transferring member inside the developing apparatus provided with a toner transferring mechanism as seen from a side of the first agitating and transferring member, and FIG. 10 is a perspective view of a scraping member of the toner transferring mechanism. Since a construction of this embodiment is basically the same as those of the first and second embodiments described with reference to FIGS. 1 to 6, neither illustration nor description of the same components as those found in the first and second embodiments will be given.

A toner transferring mechanism according to a fifth embodiment is provided with a plurality of scraping members 68 as shown in FIGS. 9 and 10. The scraping members 68 are arranged at a regular interval in the axial direction of the second agitating and transferring member 62. The scraping members 68 adjacent to each other form an interval Pb which is approximate to a spiral pitch Pa of the blade portion 62*a* of the second agitating and transferring member 62, and which is smaller than the spiral pitch Pa.

Moreover, the scraping members are composed of a sheet-like member as shown in FIG. 10. The scraping members 68 are formed integrally with a holding portion 68*a* being held in the housing 51 with the holding member 64, and are each provided with a contact portion 68*b* making contact with the blade portion 62*a* of the second agitating and transferring member 62, and a load absorbing portion 68*c* between these portions 68*a* and 68*b*. The load absorbing portion 68*c* is formed by providing an opening 68*d* in the sheet-like member, and can be elastically deformed preceding the other portions such as the holding portion 68*a* and the contact portion 68*b*.

Even when the load absorbing portions 68*c* are formed as described above, as in the second embodiment, it is possible to obtain a structure that can absorb a repeated load imposed on the scraping members 68, with a simple construction.

Thus, it is possible to provide the toner transferring mechanism that can avoid breakage of the scraping members 68, and that can thus maintain satisfactory toner transfer performance, with ease.

The sheet-like scraping members 68 can be mounted on the housing 51 without using the holding member 64, and moreover they can be mounted at any position on the housing 51.

The embodiments of the present invention have been specifically described are not meant to limit the scope of the present invention, and various changes can be made in practicing the present invention without departing from the spirit of the invention.

For example, although the foregoing deals with the embodiments in which the toner transferring mechanism 60 of the present invention is mounted, for agitating and transferring toner, in the developing apparatus 50 incorporated in the image forming section 20 of the image forming apparatus 1, this is not meant to limit where to mount the toner transferring mechanism 60; it may be mounted, for discharging waste toner, inside the cleaning apparatus 70 of the same image forming section 20. In this case, the scraping members 63 are so arranged as to have contact with the toner discharging screw 74, thereby making it possible to avoid adherence of toner to the toner discharging screw 74, and to maintain satisfactory toner transfer (discharging) performance. Moreover, the toner transferring mechanism 60 may be mounted in any apparatus other than the image forming apparatus 1.

Moreover, although the foregoing deals with the embodiments in which the image forming apparatus 1 incorporating the toner transferring mechanism 60 is an image forming apparatus, for monochrome printing, using black toner alone, this is not meant to limit the type of image forming apparatus; it may be of either a tandem or rotary rack type image forming apparatus, for color printing, provided with an intermediate transfer belt and being capable of forming an image by laying a plurality of colors one over another.

In addition, the forgoing first to fifth embodiments, each specifically describing the scraping member of the present invention, may also be practiced in combination.

What is claimed is:

1. A toner transferring mechanism comprising:

an agitating and transferring member disposed in a housing accommodating toner, and having a blade portion thereof formed in a spiral shape on a circumferential portion of a rotatable shaft portion; and a plurality of scraping members making contact with the agitating and transferring member, and then scraping toner adhering to the agitating and transferring member, the scraping members arranged in an axial direction of the agitating and transferring member, wherein the scraping members are each formed with a wire-like member, and the scraping members are each provided with a load absorbing portion located between a holding portion at which each of the scraping members is held in the housing and a contact portion making contact with the blade portion of the agitating and transferring member, the load absorbing portion being formed into a coil that is elastically deformable preceding any other portion of the scraping member.

2. A developing apparatus provided with the toner transferring mechanism of claim 1.

3. An image forming apparatus provided with the toner transferring mechanism of claim 1.

4. The toner transfer mechanism of claim 1, wherein the plurality of scraping members are arranged side by side so that the scraping members adjacent to each other form an interval which is approximate to a spiral pitch of the blade portion of the agitating and transferring member.

5. The toner transfer mechanism of claim 4, wherein the plurality of scraping members are arranged at a regular interval which is smaller than the spiral pitch of the blade portion of the agitating and transferring member.

6. A toner transferring mechanism comprising:

an agitating and transferring member disposed in a housing accommodating toner, and having a blade portion thereof formed in a spiral shape on a circumferential portion of a rotatable shaft portion; and a plurality of scraping members making contact with the agitating and transferring member, and then scraping toner adhering to the agitating and transferring member, the scraping members being arranged in an axial direction of the agitating and transferring member, wherein the scraping members are each formed with a sheet-like member, and the scraping members are each provided with a load absorbing portion located between a holding portion at which each of the scraping members is held in the housing and a contact portion making contact with the blade portion of the agitating and transferring member, the load absorbing portion having an opening and being elastically deformable preceding any other portion of the scraping member.

7. A developing apparatus provided with the toner transferring mechanism of claim 6.

8. An image forming apparatus provided with the toner transferring mechanism of claim 6.

9. The toner transfer mechanism of claim 6, wherein the plurality of scraping members are arranged side by side so that the scraping members adjacent to each other form an interval which is approximate to a spiral pitch of the blade portion of the agitating and transferring member.

10. The toner transfer mechanism of claim 9, wherein the plurality of scraping members are arranged at a regular interval which is smaller than the spiral pitch of the blade portion of the agitating and transferring member.

* * * * *